US007431483B1

(12) United States Patent
Lee

(10) Patent No.: US 7,431,483 B1
(45) Date of Patent: Oct. 7, 2008

(54) ILLUMINATING LAMP

(76) Inventor: Shih-Lin Lee, No.22,Lane 81,Sec.2,Tunhwa S. Rd., Taipei City (TW)

( * ) Notice: Subject to any disclaimer, the term of this patent is extended or adjusted under 35 U.S.C. 154(b) by 0 days.

(21) Appl. No.: 11/935,609

(22) Filed: Nov. 6, 2007

(51) Int. Cl.
*F21S 8/00* (2006.01)

(52) U.S. Cl. ..... 362/423; 362/386; 362/286

(58) Field of Classification Search ..... 362/35, 362/167–168, 174–177, 184, 199, 286–287, 362/386, 399, 419, 423, 428, 324, 271–272; 340/815.4–815.45, 815.86, 815.87; 446/242, 446/485

See application file for complete search history.

(56) References Cited

U.S. PATENT DOCUMENTS

2005/0063179 A1* 3/2005 Niemann ..... 362/184
2006/0017586 A1* 1/2006 Suzuki et al. ..... 340/815.4
2006/0262526 A1* 11/2006 Dubois ..... 362/184
2007/0064425 A1* 3/2007 Frecska et al. ..... 362/253
2007/0159816 A1* 7/2007 Bayat et al. ..... 362/184

* cited by examiner

*Primary Examiner*—Jong-Suk (James) Lee
*Assistant Examiner*—Julie A Shallenberger
(74) *Attorney, Agent, or Firm*—WPAT, P.C.; Anthony King

(57) ABSTRACT

An illuminating lamp having a grip, a transparent sleeve, being attached to the front end of the grip, and three lamp receptacles side by side being provided in the transparent sleeve, wherein an intermediate lamp is fixed in the transparent sleeve, and the pivot axis on the tail ends of the left and right lamp receptacle out of the bottom surface of the transparent sleeve whereby the left and right lamp receptacle is capable of rotating in the transparent sleeve; two driven gears engaged with each other are fit on the pivot axis, one of the two driven gears being engaged with a transmission gear; and a rotor provided between the transparent sleeve and the grip, on the inner wall of the rotor being provided with a teeth to engage with the transmission gear; wherein when the rotor rotates, the transmission gear will be driven by the teeth on the inner wall of the rotor, and the transmission gear will sequentially transmit the force to drive the two driven gears to rotate, and simultaneously the left and right lamp receptacle rotates whereby the user may render the three lamp receptacles in connection to appear triangle or rectilinear to select a unidirectional or omnidirectional illumination depending on need.

7 Claims, 5 Drawing Sheets

ILLUMINATING LAMP

BACKGROUND OF THE INVENTION

1. Field of the Invention

This invention relates to an illuminating lamp, particularly to an illuminating lamp wherein three lamp receptacles in connection may be switched to appear roughly triangular or rectilinear whereby a unidirectional or omnidirectional illumination is selected depending on the need in illumination.

2. Description of the Prior Art

Lamps such as road lamps, garden lamps, interior lamps, flash lights, work lamps and so forth are illuminators required indoors or outdoors. The illumination of the lamp helps defend the household at night because the illumination prevents theft that often occurs in the darkness and reinforces security. There is no doubt the illuminating lamp is convenient. However, the problem with such an illuminating lamp despite its usefulness is in use, the illuminating source can only proceed a unidirectional illumination, not allowing to alternatively proceed an omnidirectional illumination depending on the need in illumination.

In view of the above, the conventional illuminating lamp is inherent with a lot of drawbacks. It is far from being a good design and anticipated for improvement.

To improve the drawbacks of the conventional illuminating lamp, the inventors of this invention has taken efforts in the relevant R & D for many years and has ultimately accomplished a novel illuminating lamp.

SUMMARY OF THE INVENTION

An object of this invention is to provide an illuminating lamp which may select the illuminating source and perform a unidirectional or omnidirectional illumination depending on the need in illumination.

Another object of this invention is to provide an illuminating lamp which is simple and convenient in operation and has high utility.

To achieve the above objects, an illuminating lamp of this invention comprises: a grip, a rotor, a base, two driven gears, a transmission gear, a transparent sleeve, three lamp receptacles a positioning cover, and a cover body. A positioning board is attached to the top surface of the grip, while a plurality of positioning hollow pillars are provided on the positioning board. A plurality of through holes, two pivot holes and a positioning hole are provided on the bottom surface of the transparent sleeve. Two pivot holes and a positioning hole are provided on the positioning cover. A plurality of fixing pillars extend from the bottom surface of the positioning cover. The positioning cover is received in the sleeve in a way that those fixing pillars extending from the bottom surface of the positioning cover penetrate through these through holes on the bottom surface of the transparent sleeve, and two pivot holes and the positioning hole of the positioning cover and two pivot holes and the positioning hole of the transparent sleeve align with one another. A peripheral wall having a notch thereon extends from the bottom surface of the base. A projecting pillar is provided near the notch of the peripheral wall. The projecting pillar is fit in a hole of a transmission gear in a way that the transmission gear is pivoted on the projecting pillar and one side of the transmission gear is exposed out of the notch of the peripheral wall. Two pivot holes and a plurality of through holes are provided on the bottom surface of the base. The top surface of the base and the outer bottom surface of the transparent sleeve are joined with each other in such a way that the fixing pillar on the positioning cover penetrates through the through hole whereby the transparent sleeve is tightly held in position, and two pivot holes of the positioning cover, two pivot holes of the transparent sleeve and the limiting slot of the base align with one another. On the inner wall of the rotor is provided with a teeth for the rotor to be fit on the peripheral wall of the base whereby the teeth of the rotor is engaged with the transmission gear. Three lamp receptacles in series are incorporated in the transparent sleeve, wherein the intermediate lamp receptacle is fixed in the positioning hole of the positioning cover and the transparent sleeve, while the pivot axis on the lower end of the left and right lamp receptacle penetrate the pivoting hole of the positioning cover to be exposed out of the bottom surface of the base at most. Two driven gears are respectively fastened on the two pivot axes for these two driven gears to be engaged with each other wherein a driven gear is engaged with the transmission gear. The base is attached to the positioning panel of the grip whereby the fixing pillar is tightly fit in the positioning hollow pillar of the positioning board. Consequently, the rotor is held in position between the base and the positioning board and is capable of rotating along the peripheral wall. The cover body is fastened onto the top surface of the transparent sleeve by means of screws to seal the transparent sleeve. When the rotor rotates, the teeth on the inner wall thereof will then drive the transmission gear to rotate whereby the transmission gear may sequentially transmit the force to drive the driven gears to rotate, resulting in the rotation of the left and right lamp receptacle. Accordingly, the user may switch these three lamp receptacles in connection to appear roughly in triangle or rectilinear to select a unidirectional or omnidirectional illumination depending on the need in illumination.

These features and advantages of the present invention will be fully understood and appreciated from the following detailed description of the accompanying Drawings.

DETAILED DESCRIPTION OF THE PREFERRED EMBODIMENT

Figure 1A:
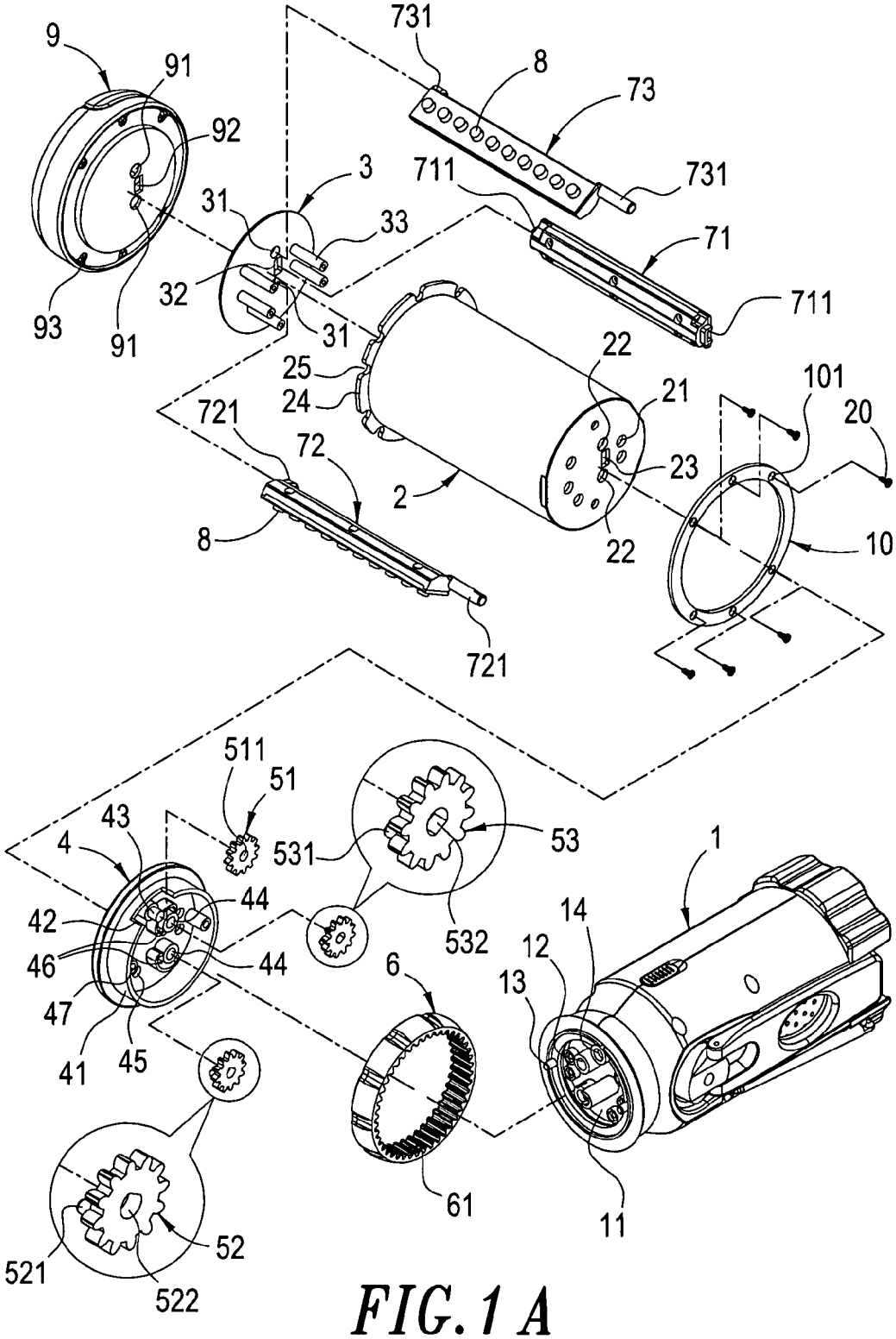
FIG. 1 is an exploded view schematically showing the assemblage of the illuminating lamp according to the present invention.
Figure 1B:
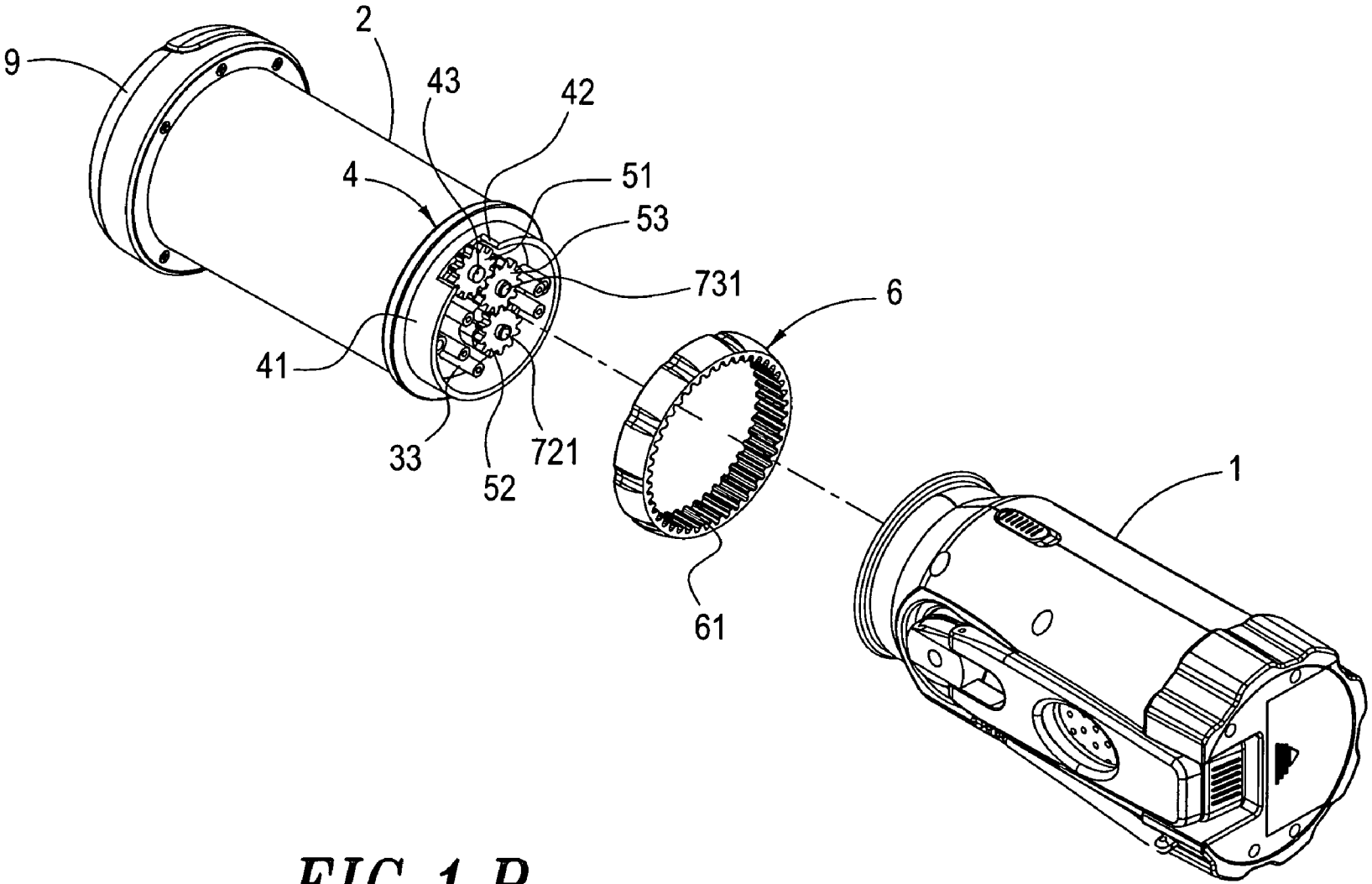
Figure 2:
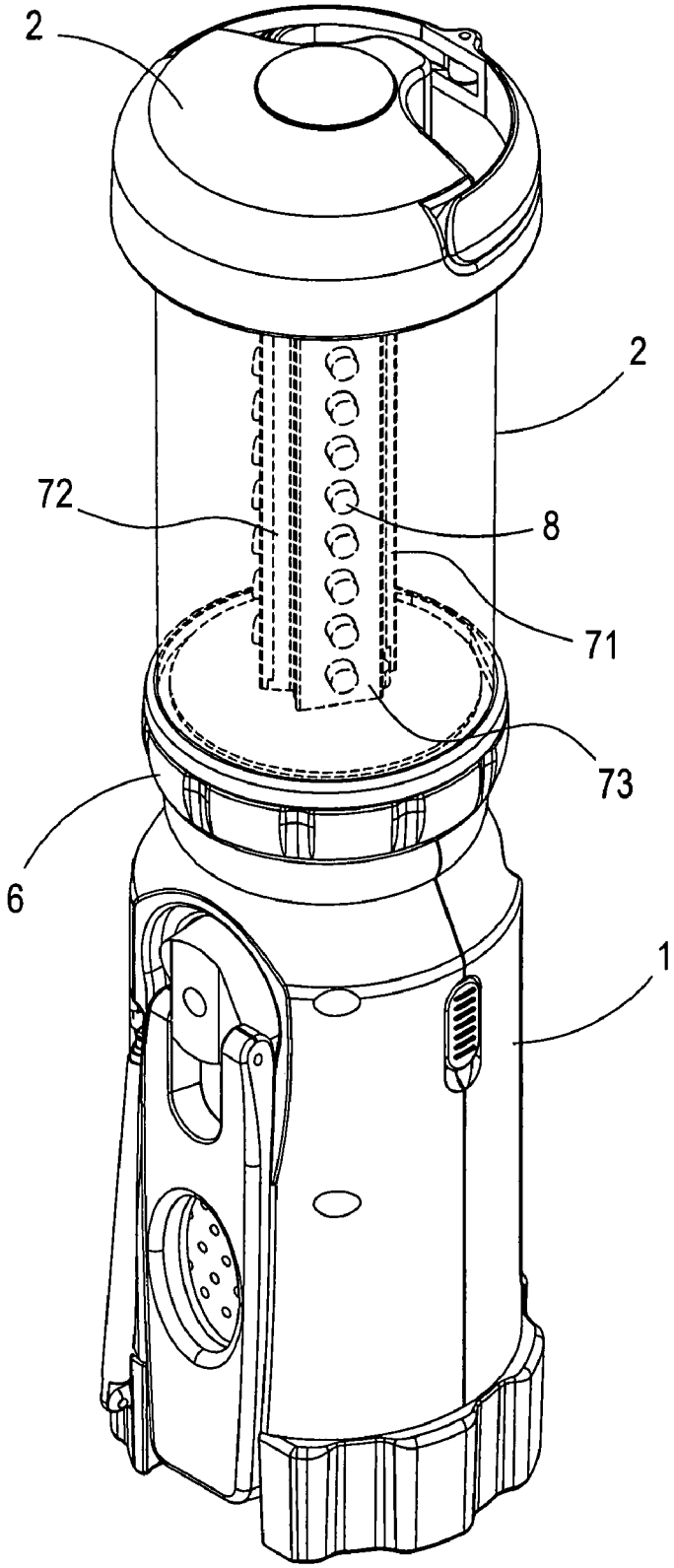
FIG. 2 is a perspective view schematically showing the illuminating lamp according to the present invention.

Referring to FIG. 1A, 1B to FIG. 2, an illuminating lamp provided by this invention mainly comprises: a grip 1, a transparent sleeve 2, a positioning cover 3, a base 4, a rotor 6, an intermediate lamp receptacle 71, a left lamp receptacle 72, a right lamp receptacle 73, a first driven gear 52, a second driven gear 53, a positioning ring 10, and a cover body 9.

A positioning board 11 is attached to the top surface of the grip 1, while a plurality of positioning hollow pillar 12 and an axial hole 14 are provided on the positioning board 11, and furthermore, a positioning solid pillar 13 is provided on each of both sides thereof.

A plurality of through holes 21, two pivot holes 22 and a positioning hole 23 are provided on the bottom surface of the transparent sleeve 2. These two pivot holes 22 are respectively provided on both sides of the positioning hole 23. A rim collar 24 with a plurality of notches 25 thereon extends on the tip of said transparent sleeve 2.

The top surface of the positioning cover 3 has the function of reflection. Two pivot holes 31 and a positioning hole 32 are provided on the positioning cover 3. These two pivot holes 22 are respectively located on both sides of the positioning hole 32. A plurality of fixing pillars 33 extend from the bottom surface of the positioning cover 3. The positioning cover 3 is received in the sleeve 2 in a way that those fixing pillars 33 extending from the bottom surface of the positioning cover 3 penetrate through these through holes 21 on the bottom surface of the transparent sleeve 2 whereby the bottom surface of the positioning cover 3 adheres to the inner bottom surface of the transparent sleeve 2 each other, while two pivot holes 31 and the positioning hole 32 of the positioning cover 3 and two pivot holes 22 and the positioning hole 23 of the transparent sleeve 2 align with one another.

A peripheral wall 41 having a notch 42 extends from the base 4. A projecting pillar 43 is provided near the notch 42 of the peripheral wall 41. The projecting pillar 43 is fit in a hole 511 of a transmission gear 51 in a way that the transmission gear 51 is pivoted on the projecting pillar 43 and one side of the transmission gear 51 is exposed out of the notch 42 of the peripheral wall 41. Two pivot holes 44 and a plurality of through holes 45 are provided on the bottom surface of the base 4. A limiting slot 46 is provided on one side of these two pivot holes 44 while a positioning hollow pillow 47 is provided on each of both sides of the bottom surface of the base 4. The top surface of the base 4 and the outer bottom surface of the transparent sleeve 2 are attached to each other in such a way that the fixing pillar 33 on the positioning cover 3 penetrates through the through hole 45 whereby the transparent sleeve 2 is tightly held in position, and two pivot holes 31 of the positioning cover 3, two pivot holes 22 of the transparent sleeve 2 and the limiting slot 46 of the base 4 align with one another.

On the inner wall of the rotor 6 is provided with a teeth 61 for the rotor 6 to be fit on the peripheral wall 41 of the base 4 whereby the teeth 61 of the rotor 6 is engaged with the transmission gear 51.

A plurality of illuminators (not depicted with reference number in the drawings) are projected from the surface of the intermediate lamp receptacle 71 on the upper and lower end of which respectively extends a fixing pillar 711. The fixing pillar 711 on the lower end thereof is fit in the positioning hole 32 of the positioning cover 3 and the positioning hole 23 of the transparent sleeve 2.

A plurality of illuminators are projected from the surface of the left and right lamp receptacle 72,73 on the upper and lower end of which respectively extends a pivot axis 721,723. The pivot axis 721,723 on the lower end thereof penetrate the pivoting hole 31 of the positioning cover 3, the pivoting hole 22 of the transparent sleeve 2 and the pivoting hole 44 of the base 4 for the pivot axis 721,723 of the left and right lamp receptacle 72, 73 projects from the bottom surface of the base 4 whereby the left and right lamp receptacle 72, 73 are located on both sides of the intermediate lamp receptacle 71 and abut thereon.

Limiting pillars 521,531 respectively extends on the surface of the first and second driven gear 52,53 while fixing holes 522,532 are provided near the central portion thereof. The pivot axis 721,723 of the left and right lamp receptacle 72, 73 are fit in the fixing holes 522,532 of the first and second driven gear 52,53 whereby the first and second driven gear 52,53 are respectively secured to the pivot axis 721,723 of the left and right lamp receptacle 72, 73. Consequently, the limiting pillars 521,531 of the first and second driven gear 52,53 enter into the limiting slot 46 so that the rotation stroke of the first and second driven gear 52,53 is limited. The first and second driven gear 52,53 are engaged with each other while the second driven gear 53 is engaged with the transmission gear 51 whereby the transmission gear 51 may simultaneously transmit the force to drive the first and second driven gear 52,53 to move.

A plurality of holes 101 are provided on the positioning ring 10. The positioning ring 10 is sleeved on the transparent sleeve 2 and attached to the bottom surface of the rim collar 24 wherein the holes 101 on the positioning ring 10 align with the notch 25 of the rim collar 25.

Two pivot holes 91 and a positioning hole 92 are provided on the bottom surface of the cover body 9, wherein these two pivot holes 91 are on both sides of the positioning hole 92. A plurality of screw holes 93 are provided on the peripheral edge of the bottom surface of the cover body 9. The cover body 9 is attached to the top end of the transparent sleeve 2 in such a way that the fixing pillar 711 on the upper end of the intermediate lamp receptacle 71 and the pivot axis 721,723 of the left and right lamp receptacle 72, 73, the intermediate lamp receptacle 71 and the left and right lamp receptacle 72, 73 being received in the transparent sleeve 2, are fit in the positioning hole 92 and these two pivot holes 91, wherein the screw holes 93 on the peripheral edge of the bottom surface of the cover body 9 is in alignment with the notch 25 of the rim collar 25 and the holes 101 on the positioning ring 10. The cover body 9 is secured onto the top surface of the transparent sleeve 2 to seal the transparent sleeve 2.

The base 4 is attached to the positioning board 11 of the grip 1 whereby the fixing pillar 33 on the bottom surface of the positioning cover 3 is secured to the positioning hollow pillar 12 of the positioning board 11 while the positioning hollow pillow 47 on both sides of the bottom surface of the base 4 and the positioning solid pillar 13 on both sides of the grip 1 is secured to each other, resulting in that the transparent sleeve 2 and the grip 1 are integrated into one unit. The rotor 6 is held in position between the base 4 and the positioning board 11 and a capable of rotating along the peripheral wall 41 of the base 4.

Figure 3B:
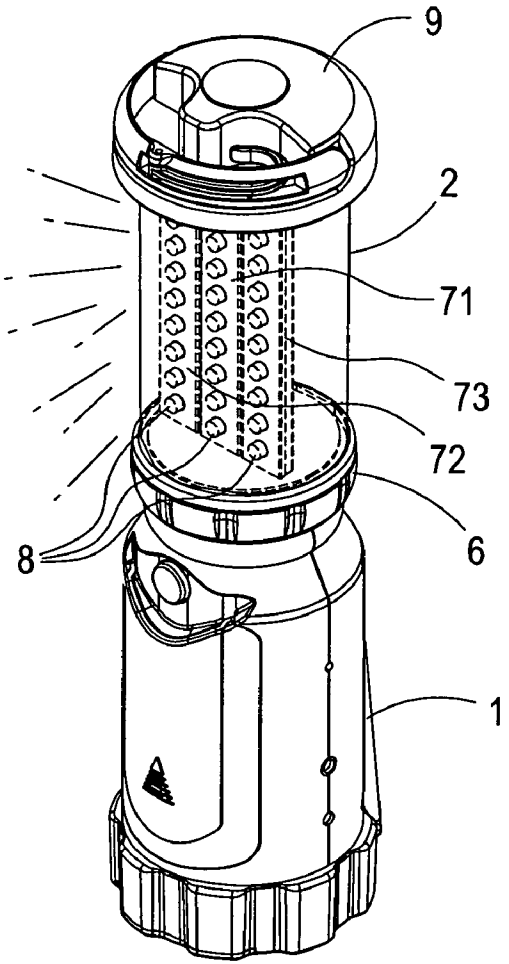
FIGS. 3A, 3B are views schematically showing the operation of the illuminating lamp according to the present invention.
Figure 3A:
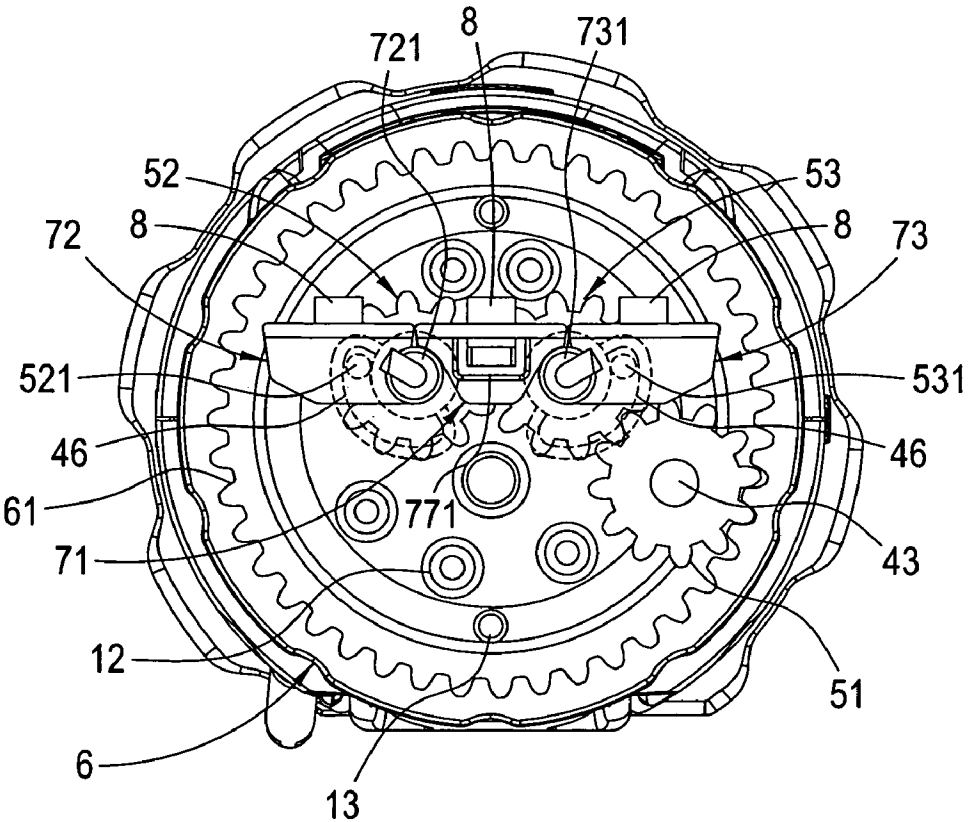
Figure 4B:
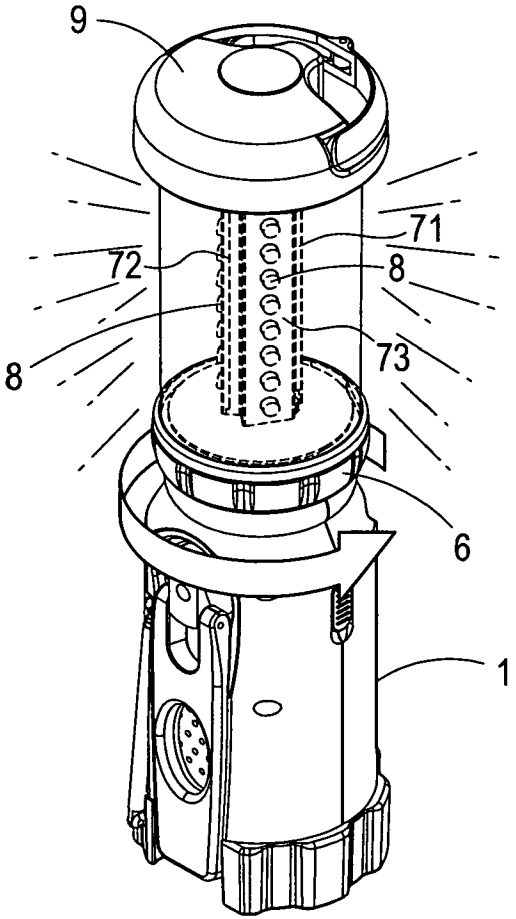
FIGS. 4A, 4B are views schematically showing the operation of the illuminating lamp according to the present invention.
Figure 4A:
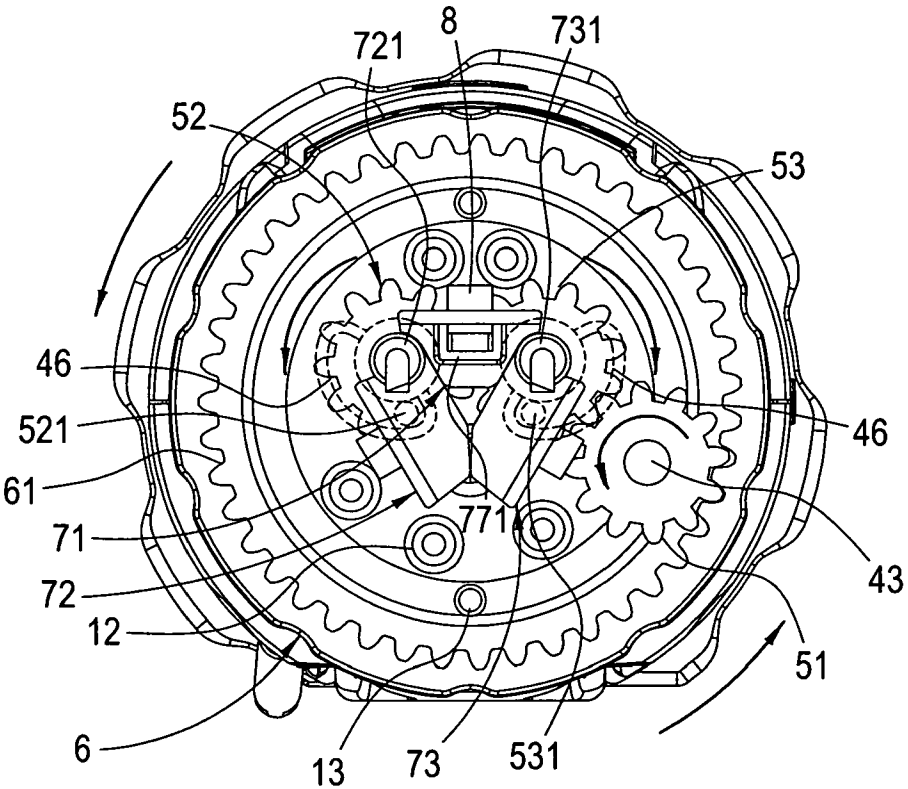

Now, refers to FIG. 3A, B and FIGS. 4A, 4B schematically showing the operation of this invention. As shown in FIGS. 3A, 3B, the intermediate lamp receptacle 71 and the left and right lamp receptacle 72,73 are disposed side by side whereby the illuminator 8 on the surface of the intermediate lamp receptacle 71 and the left and right lamp receptacle 72,73 proceed a unidirectional illumination. In case of an omnidirectional illumination to be selected, the user rotates the rotor 6 at an angle, whereby the transmission gear 51 is driven to rotate upon engagement with the teeth 61 of the rotor 6. The transmission gear 51 will transmit the force to drive the second driven gear 53 to rotate. Simultaneously, the second driven gear 53 will drive the first driven gear 52 to rotate. For the first and second driven gear 52,53 are joined with the left and right lamp receptacle 72, 73, the left and right lamp receptacle 72, 73 will rotate with the result that the left and right lamp receptacle 72, 73 and the intermediate lamp receptacle 71 in connection roughly appear triangle whereby the illuminator 8 on the surface of the intermediate lamp receptacle 71 and the left and right lamp receptacle 72,73 illuminates in different directions to achieve the object of a unidirectional illumination.

Furthermore, since the first and second driven gears 52,53 are affected by the limitation the limiting slot 46, the rotation angle thereof is limited in such a way that the greatest stoke of rotation of the rotor 6 is equal to the length of the limiting slot 46. Accordingly, the intermediate lamp receptacle 71 and the left and right lamp receptacle 72, 73 in connection will accurately appear in triangle or rectilinear to proceed a unidirectional or omnidirectional illumination depending on the need in illumination.

In comparison with the relevant conventional art, an illuminating lamp according to this invention has the following advantages:

(1) this invention allows the illuminating source to select a unidirectional or omnidirectional illumination depending on the need in illumination; and (2) this invention is simple and convenient in operation and has high utility.

Many changes and modifications in the above described embodiment of the invention can, of course, be carried out without departing from the scope thereof.

What is claimed is:

1. An illuminating lamp, comprising:

a grip, a positioning board being attached to the top surface of said grip; a transparent sleeve, a cover body being attached to the top surface of said transparent sleeve; an intermediate lamp receptacle being held in position in said transparent sleeve, while left and right lamp receptacle being pivoted therein; said left and right lamp receptacle being provided on both sides of said intermediate lamp and about thereto, whereby said left and right lamp receptacle are capable of rotating in said transparent sleeve, and a pivot axis below said left and right lamp receptacle penetrates out of the bottom surface of said transparent sleeve;

a base, a peripheral wall which has a notch extending from said base; a transmission gear which projects out of said notch on said peripheral wall of said base being pivotally provided near said notch; said base being secured to the bottom surface of said transparent sleeve in such a way that said pivot axis below said left and right lamp receptacle penetrates out of the bottom surface of said base; each of said two pivot axis being joined with said driven gears engaged with each other, wherein one of two driven gears is engaged with said transmission gear whereby said two driven gears cooperate with said transmission gear to move;

a rotor, the inner wall of said rotor being provided with teeth for said rotor to be fit on said peripheral wall of said base whereby said teeth of said rotor is engaged with said transmission gear;

said base is attached to said positioning board of said grip whereby said rotor is held in position between said base and said positioning board and is capable of rotating along the peripheral wall; and when said rotor upon rotation drives said transmission gear to rotate, said transmission gear will transmit the force to drive said two driven gears to rotate, and simultaneously said left and right lamp receptacle rotates with the result that said intermediate lamp and said left and right lamp receptacle in connection appears in a triangle or rectilinear configuration.

2. An illuminating lamp according to claim 1, wherein a plurality of positioning hollow pillars are provided on said positioning board; a positioning cover is attached to the inner bottom surface of said transparent sleeve; and a plurality of fixing pillars extends from the bottom surface of said positioning cover, while through holes in correspondence therewith are provided on the bottom surface of said transparent sleeve and the surface of said base, whereby said fixing pillars of said positioning cover penetrate said through holes of said transparent sleeve and said base to fit in said positioning hollow pillar to integrate said transparent sleeve, said base and said grip into one unit.

3. An illuminating lamp according to claim 1, wherein a plurality of illuminators are provided on the surface of said intermediate lamp receptacle; and a fixing pillar extends from the upper and lower end face of said intermediate lamp receptacle, while a positioning hole is provided on the bottom surface of said transparent sleeve and said cover body, said positioning hole being provided for said fixing pillar on the upper and lower end face to fit therein whereby said intermediate lamp receptacle is held in position.

4. An illuminating lamp according to claim 1, wherein a plurality of illuminators are provided on the surface of said left and right lamp receptacle; and a pivot axis extends from the upper and lower end face of said left and right lamp receptacle, while two pivot holes in correspondence therewith are provided on the bottom surface of said transparent sleeve and said cover body, said two pivot holes being provided for said pivot axis the upper and lower end face to fit therein whereby said left and right lamp receptacle are capable of rotating in said transparent sleeve.

5. An illuminating lamp according to claim 1, wherein a rim collar extends on the tip of said transparent sleeve, said rim collar having a plurality of notches thereon; a positioning ring is attached to the bottom surface of said rim collar; a plurality of holes corresponding to said notch of aid rim collar are provided on said positioning ring; a plurality of screw holes are provided on the peripheral rim of the bottom surface of said cover body; and said screw holes are in alignment with said notch of aid rim collar and said holes of said positioning ring, whereby said cover body is secured to the top surface of said transparent sleeve by means of said screws.

6. An illuminating lamp according to claim 1, wherein a projecting pillar is provided near said notch of said peripheral wall of said base for said transmission gear to be pivoted thereon and said transmission gear to be exposed out of said notch of said peripheral wall.

7. An illuminating lamp according to claim 1, wherein two pivot holes for said pivot axis on the lower end of said left and right lamp receptacle to penetrate through are provided in said base, while a limiting slot is provided one side of said two pivot holes, and a limiting pillar on each of said two driven gear, whereby in case that said two driven gears are respectively secured on said pivot axis of said left and right lamp receptacle, said limiting pillar on said two driven gears will enter into said limiting slot to limit the rotation stroke of said two driven gears.

* * * * *